US009468824B1

(12) United States Patent
Miceli

(10) Patent No.: US 9,468,824 B1
(45) Date of Patent: Oct. 18, 2016

(54) LACROSSE MESH

(71) Applicant: James Miceli, Minneapolis, MN (US)

(72) Inventor: James Miceli, Minneapolis, MN (US)

(73) Assignee: Epoch Lacrosse LLC

( * ) Notice: Subject to any disclaimer, the term of this patent is extended or adjusted under 35 U.S.C. 154(b) by 0 days.

(21) Appl. No.: 14/243,965

(22) Filed: Apr. 3, 2014

(51) Int. Cl.
*A63B 59/02* (2006.01)
*A63B 65/12* (2006.01)

(52) U.S. Cl.
CPC ..... *A63B 59/02* (2013.01)

(58) Field of Classification Search
CPC ..... A63B 59/02; A63B 65/12
USPC ..... 473/505, 512, 513
See application file for complete search history.

(56) References Cited

U.S. PATENT DOCUMENTS

| | | | | |
|---|---|---|---|---|
| 2,992,550 | A * | 7/1961 | Frith, Jr. | 66/195 |
| 3,171,272 | A * | 3/1965 | Frith | 66/195 |
| 3,511,032 | A * | 5/1970 | Demuth | 56/1 |
| 5,442,875 | A * | 8/1995 | Brundage et al. | 43/11 |
| 6,520,875 | B1 * | 2/2003 | Crawford | 473/513 |
| 7,074,483 | B2 * | 7/2006 | Morin | D01D 5/098 428/364 |
| 7,445,834 | B2 * | 11/2008 | Morin | C04B 16/0633 428/293.7 |
| 7,445,842 | B2 * | 11/2008 | Morin | D01D 5/098 428/364 |
| 7,445,843 | B2 * | 11/2008 | Lutz et al. | 428/364 |
| 2014/0103566 | A1 * | 4/2014 | Janisse | B29C 70/688 264/161 |

OTHER PUBLICATIONS

Webpage download, Innegratech2013, 2012, web.archive.org/web/20130714030942/http://www.innegratech.com/applications/ropes_netting/, 12 pages.*
Webpage download, Laxallstars2012. 2012, www.laxallstars.com/show-las-your-old-school-way-back-mesh-kit/, 6 pages.*
Webpage download, Plastics2004. 2004, //plastics.americanchemistry.com/hands_on_plastics2/activities/pdfs/day4.pdf, 7 pages.*
Webpage download, dotmar. 2010, web.archive.org/web/20100429055918/http://www.dotmar.com.au/density.html, 2 pages.*
Webpage download, innegratech2008, 2008,www.innegratech.com/#!technical/flls0/, 31 pages.*

* cited by examiner

*Primary Examiner* — Gene Kim
*Assistant Examiner* — Michael Chambers
(74) *Attorney, Agent, or Firm* — H. Jay Spiegel

(57) ABSTRACT

An improved lacrosse mesh is made of polypropylene. Polypropylene fibers are among the lightest weight of all commercially produced plastic fibers. Typical polypropylene has a density of 0.9 g/cm$^3$, much lower than that of polyester (1.38), cotton (1.54), or nylon (1.15). Additionally, polypropylene is known to outperform other dyeable fibers in low moisture absorption tests. Preferably a polypropylene-based material known as INNEGRA S is employed. It has a tenacity greater than 5 grams/denier, elongation prior to breakage of about 11%, density of 0.84 g/cm$^3$, 93% of unprocessed polypropylene and a surface texture bearing striations that enhance its grippability to a degree desirable for use in netting for lacrosse mesh. The INNEGRA S material is much more difficult to stretch to any degree as compared to the more easily stretchable NYLON material and, as such, ideally maintains pocket shape in a wide variety of conditions.

3 Claims, 2 Drawing Sheets

LACROSSE MESH

BACKGROUND OF THE INVENTION

The present invention relates to an improved lacrosse mesh. Mesh used in creating the pocket for a lacrosse stick is an extremely specialized area of technology. Mesh employed in other environments of use fails to contemplate the specialized environment of use of a lacrosse stick.

The typical environment of use of a lacrosse stick consists of an outdoor playing field, either synthetic or of natural turf utilized between the months of February and June, and often in the Northeastern United States. That environment, during that time period, exhibits an extremely wide range of temperatures. Game time temperatures can often be in the 20s F with oppressive wind conditions, and often rain and snow. Natural turf fields can often be muddy or even icy.

It is an important aspect of the art of mesh used as a pocket in a lacrosse stick that the player wishes the pocket to remain relatively stable in terms of its flexibility/stiffness, size, and configuration so that a player practicing with a lacrosse stick, for example, indoors, will have the same results when going outside in drastically different outdoor conditions.

Moreover, lacrosse players are often responsible for the maintenance of their sticks. They must install the mesh pocket, maintain the installation, repair any damage, and also make sure that the dimensions and depth of the pocket fully comply with high school or college rules.

Sometimes, there are other maintenance requirements. For example, some mesh pockets on lacrosse sticks include a coating applied over the mesh for one purpose or another, for example, to enhance stiffness or flexibility, to render the mesh waterproof, or to more easily facilitate removal of mud or other debris from the mesh pocket. When such coatings are used, they often deteriorate or otherwise require replenishment or re-coating. Players often do not recognize when replenishment or re-coating might be necessary and, as such, use of mesh pockets bearing a coating can sometimes be problematic.

As such, a need has developed for a mesh used in the specialized area of lacrosse sticks that is relatively maintenance free, requires no re-coating, stays consistent in shape, configuration, and stiffness/flexibility under a wide variety of temperature and moisture conditions, and allows a player's practice performance to be re-created on a lacrosse field during a game.

There are other aspects of the environment of lacrosse sticks that render it extremely specialized. In particular, a lacrosse player must swing the stick in order to pass or shoot the lacrosse ball. The lighter the stick is and the lower its wind resistance, the faster the stick can be swung to enhance speed of passes and shots. Thus, if the mesh for a lacrosse stick is susceptible to a great degree of stretching, the openings therein must be made smaller to ensure they don't stretch to too large a size. Similarly, as the holes in the mesh are smaller, more mesh material is required in order to cover the opening in the crosse in which the mesh is strung.

It is well known that the force that must be applied is proportional to the mass and to the square of the velocity. What this means is that for equal force application, the lower the mass the higher the velocity achievable in an exponential way since a proportional mass reduction results in a squared velocity increase. As such, materials that perform all of the required features of mesh for a lacrosse stick that are lower in density and, as such, lighter, enable a player to swing a stick much faster with equal force application. It is with these needs in mind and with these requirements in mind that the present invention was developed.

The following prior art is known to Applicant:

| U.S. Patents | |
|---|---|
| 2,992,550 to Frith, Jr. | 7,022,035 to Morrow et al. |
| 3,171,272 to Frith, Jr. | 7,211,009 to Samaras et al. |
| 3,822,062 to Tucker et al. | 7,278,936 to Tucker, Jr. |
| 3,905,088 to Tucker et al. | |

| U.S. Published Applications | |
|---|---|
| 2001/0044347 A1 to Crawford | 2009/0082141 A1 to Wilton |
| 2007/0161436 A1 to Samaras et al. | 2012/0165140 A1 to Bound. |
| 2008/0146387 A1 to Gait | |

With regard to each of these patents and published applications, the materials they teach for use in the mesh of a lacrosse stick are any one or more of nylon, cotton or polyester. Some disclose the use of stiffening agents and other aspects including coatings. Some disclose the use of tubes installed over the strings of the mesh.

The materials nylon, polyester and cotton have deficiencies that render them less effective than should be the case for use as the mesh of a lacrosse stick. Nylon and cotton are both fluid pervious. As, such, they absorb liquid, thereby increasing their weight and changing their consistency, flexibility, and other properties. Even when dry, Applicant notes that polyester has a density of 1.38 g/cm$^3$ while nylon has a density of 1.15 g/cm$^3$ and cotton has a density of 1.54 g/cm$^3$. These densities are somewhat high as compared to other possible mesh materials and, as such, increase the weight of the lacrosse stick at its furthest distance from where its handle is gripped by the player, namely, at the head or crosse thereof. As such, in the design and configuration of mesh for lacrosse stick heads, there is certainly room for improvement, in fact dramatic improvement. Moreover, again, the liquid absorbency of nylon and cotton renders those materials less advantageous due to the wide fluctuations in weight, consistency, and other properties during use.

It would also be advantageous if a mesh could be provided for a lacrosse stick that enhances the grippability of the ball within the pocket while at the same time not increasing, to too great a degree, the ability of the ball to easily leave the mesh when the associated player wants to shoot or pass the ball. All of the aspects set forth above have been taken into account by Applicant in seeking to determine a mesh material specifically usable in the narrow environment of lacrosse sticks that most advantageously enhances performance. With this in mind, and after a considerable degree of search and experimentation, Applicant developed the present invention.

SUMMARY OF THE INVENTION

The present invention relates to an improved lacrosse mesh. The present invention includes the following interrelated objects, aspects and features:

(1) After significant search and experimentation, Applicant determined that a material that might facilitate enhanced performance of a lacrosse stick mesh pocket is the material polypropylene. Polypropylene fibers are among the lightest weight of all commercially produced plastic fibers. Typical polypropylene has a density of 0.9 g/cm$^3$, much lower than that of polyester (1.38), cotton (1.54), or nylon (1.15). Additionally, polypropylene is known to outperform other dyeable fibers in low moisture absorption tests. Thus, polypropylene has a great advantage over nylon and cotton (not to mention it is about 35% lighter than polyester). Polypropylene has excellent durability, and excellent chemical and bacterial resistance. Thus, polypropylene was found by Applicant to be an effective option for use in making mesh for lacrosse sticks.

(2) This having been determined, Applicant decided to take the development process one step further and determine if there is any polypropylene-based material on the market, never previously used as mesh for a lacrosse stick head, but which would be suitable for that specific narrow environment of use.

(3) After careful study and investigation, Applicant discovered the existence of a polypropylene-based material known as INNEGRA S manufactured by Innegra Technologies LLC. This material is disclosed in U.S. Pat. No. 7,074,483 to Morin. The face of the patent indicates assignment to Innegrity, LLC which was the predecessor name to Innegra Technologies LLC.

(4) The INNEGRA S material, which may be described as a processed polypropylene material, is disclosed as having a tenacity greater than 5 grams/denier, an elongation prior to breakage of about 11%, a density of 0.84 g/cm$^3$, 93% of unprocessed polypropylene and, notably, its fibers have rough surface texture bearing striations and crevices that Applicant has found enhance the grippability of the surface of mesh woven from INNEGRA S material to a degree desirable for use as netting for lacrosse mesh on the head of a lacrosse stick. Applicant notes that the INNEGRA S material is much more difficult to stretch to any degree as compared to the more easily stretchable nylon material and, as such, ideally maintains pocket shape in a wide variety of conditions.

(5) While the Morin patent does disclose weaving the INNEGRA S material into a multi-filament yarn, there is no teaching or suggestion of use of that material in the narrow environment of use of mesh employed in lacrosse stick heads.

(6) Applicant is also aware of the following patents, all also to Morin, that teach similar aspects, but none of which teaches the specific environment of use contemplated by Applicant: U.S. Pat. Nos. 7,648,607; 7,648,758; 7,704,595; 7,892,633; and 8,168,292.

(7) It is noteworthy that the INNEGRA S material is an effective material for use in mesh used for lacrosse stick heads without any need to provide any coatings, stiffening agents, etc. Rather, the material as woven into a mesh including a plurality of strands woven into rope and the rope woven to create the mesh and as configured to be installed on a lacrosse stick head or crosse needs no coatings or stiffening agents, is water impervious (hydrophobic), lightweight, strong, relatively non-stretchable, and maintains its shape and configuration once installed with no need for any modifications, revisions or corrections.

(8) In the preferred embodiments of the present invention, the INNEGRA S material is woven into a mesh that includes what are commonly known in the art as "diamonds," namely, diamond-shaped openings, that provide the support for a lacrosse ball held within the mesh for carrying, passing, and shooting.

(9) The INNEGRA S material requires no coatings or other surface treatments in order to effectively be employed on a lacrosse stick. As such, as compared to many prior art lacrosse meshes, the present invention is substantially maintenance free.

(10) The INNEGRA S material utilized in accordance with the teachings of the present invention is stretchable no more than 11% of its unstretched length, has a wide temperature range of use of from −120° F. to +212° F. It is hydrophobic, meaning it will not absorb water. Through the processing steps employed to create the INNEGRA S material, woven mesh has a slightly rough surface that enhances ball retention without adding "whip." It is about 50% lighter than conventional hard, wax or soft mesh and strings, and this enables a player with equal force application to dramatically enhance the speed of movement of the head resulting in crisper passing and the ability to shoot significantly harder.

(11) Applicant is unaware of any third party use of polypropylene as a material for use in making a mesh for use as a pocket on the head of a lacrosse stick. However, even if such use existed or exists, the INNEGRA S material presents unexpected results even over polypropylene. This is because the INNEGRA S material is lower in density than polypropylene, thereby reducing the weight of the mesh, and includes a slightly roughened surface that enhances ball control. The INNEGRA S material requires no coating to be effective and thus exhibits reduced maintenance requirements.

As such, it is a first object of the present invention to provide an improved lacrosse mesh.

It is a further object of the present invention to provide such a lacrosse mesh that does not require any coatings or other added materials, thereby rendering it substantially maintenance free.

It is a still further object of the present invention to provide a lacrosse mesh that is lightweight, durable, relatively non-stretchable, and maintains its shape and consistency over a wide temperature range.

It is a still further object of the present invention to provide such a lacrosse mesh that allows a user to practice and play with equal effectiveness regardless of weather conditions including temperature conditions.

It is a still further object of the present invention to provide such a lacrosse mesh that is hydrophobic while also having a slightly rough surface to enhance ball control within the pocket of the stick.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
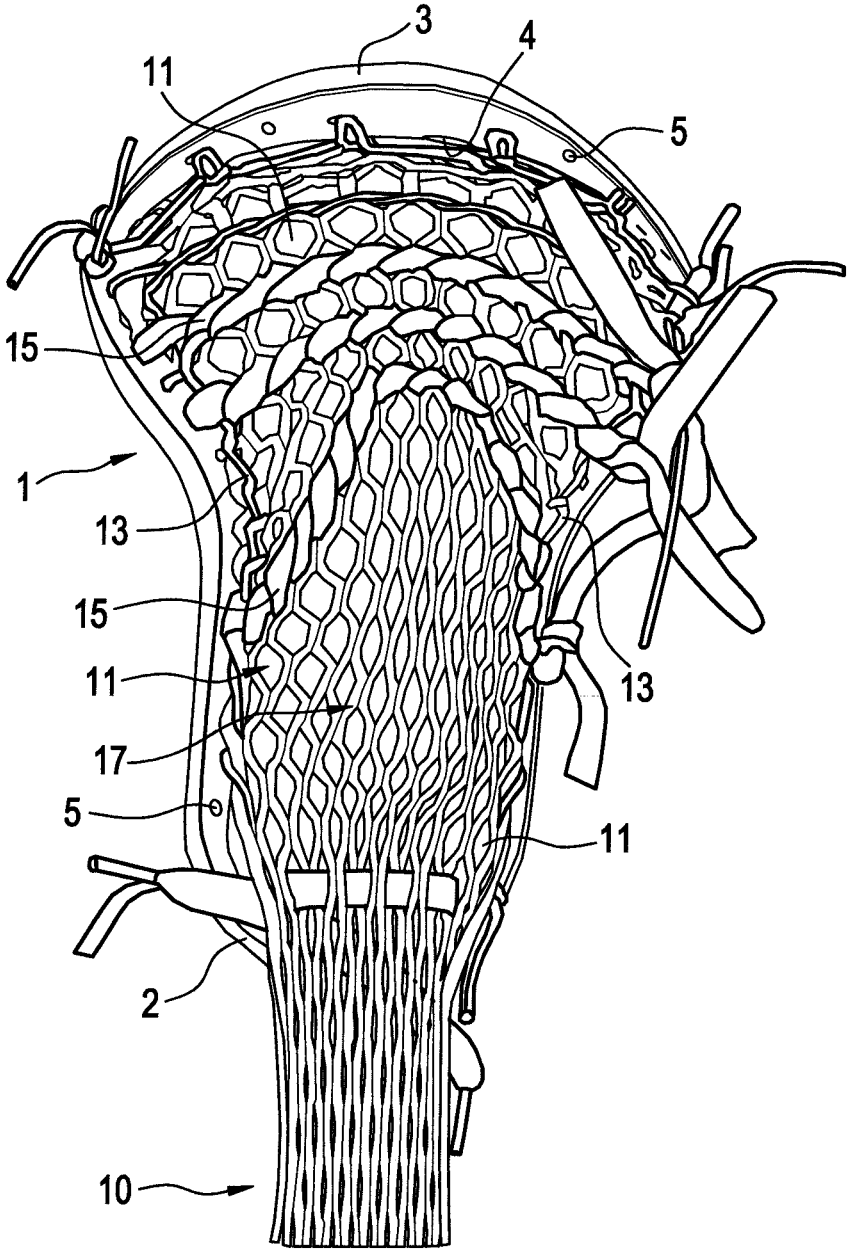
FIG. 1 shows a rear view of the head of a lacrosse stick on which is mounted a lacrosse mesh in accordance with the teachings of the present invention.

With reference, first, to FIG. 1, the head of a lacrosse stick is generally designated by the reference numeral 1 and includes a proximal end 2, and a distal scooping end 3. The proximal end 2 is connected to a handle (not shown) in a manner well understood by those skilled in the art. The lacrosse head 1 defines an opening 4 which is covered by the lacrosse mesh generally designated by the reference numeral 10.

As seen in FIG. 1, the lacrosse mesh 10 is woven to include a plurality of diamond-shaped openings 11 and is attached using holes 5 located at spaced locations about the periphery of the head 1 using a string 13. Other strings 15 comprising string sections are interwoven with the mesh 10 to create areas within the mesh 10 that best facilitate ball retention and creation of a pocket at the location 17.

Figure 2:
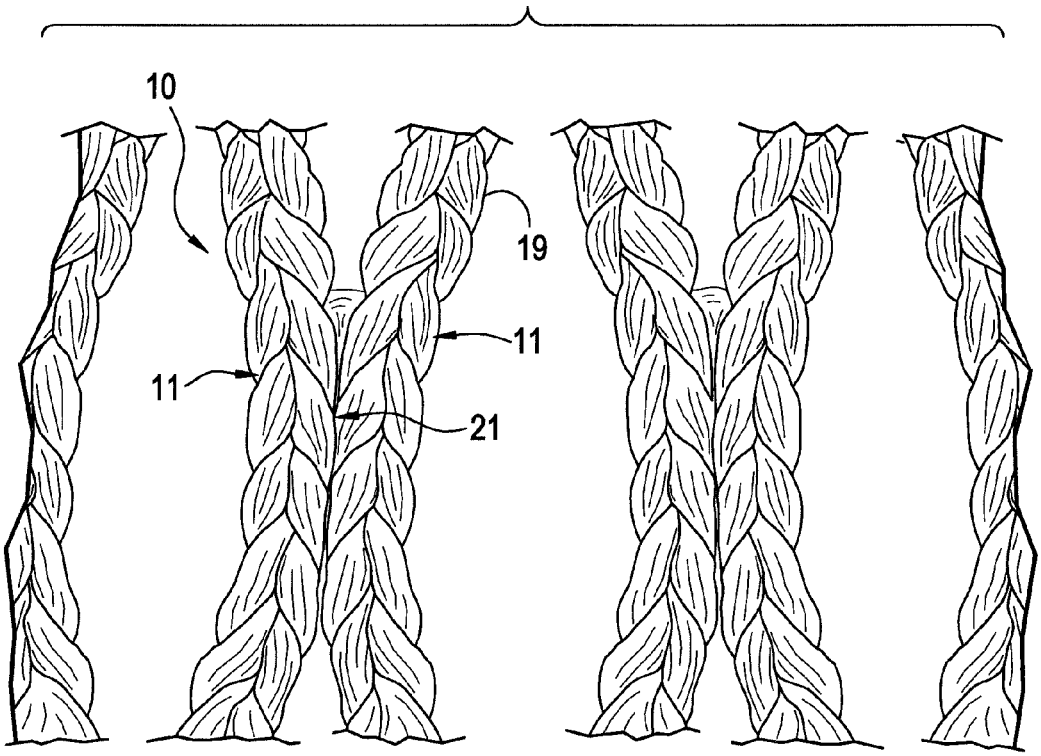
FIG. 2 shows a close-up rear view of a portion of the mesh showing certain of the woven characteristics.

With reference to FIG. 2, a portion of the mesh 10 is seen in an enlarged view. As is clear, the mesh 10 is created by a weaving 19 including intersecting portions 21 that facilitate creation of adjacent diamond-shaped openings 11.

In the preferred embodiment of the present invention, the diamond-shaped openings are sized with a length of approximately 1.5-2.0 centimeters in the proximal to distal direction and a width of approximately 1 to 1.3 centimeters in a lateral direction. Of course, this is a preferred specification and, as will be described in greater detail hereinafter, the configuration may be significantly altered based upon the material chosen for use in making the inventive lacrosse mesh 10.

Additionally, it is noted that the strands or ropes of woven mesh are preferably approximately 2 millimeters in diameter and the locations 21 where double strands intersect are preferably approximately 4 millimeters in width (FIG. 2). The strands are preferably 1.5 to 2.5 millimeters in diameter.

Figure 3:
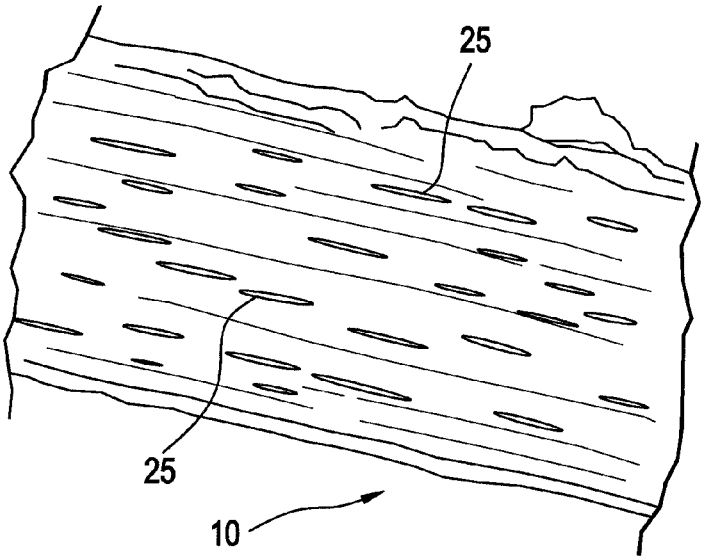
FIG. 3 shows a magnified view of a portion of the stock material used to create the lacrosse mesh showing its striations and openings.

In the preferred embodiment of the present invention, the material chosen for creating the lacrosse mesh 10 in accordance with the teachings of the present invention is known by the trademark INNEGRA S. The INNEGRA S material is fabricated from basic polypropylene and the result of the fabrication is reduced density and enhanced grippability. As seen in FIG. 3, a portion of the mesh material 10 is enlarged to show striations and crevices 25 which reduce the density of the material, but also enhance grippability by rendering the outer surfaces of the material somewhat roughened.

After experimenting with a number of potential materials, Applicant has found that the INNEGRA S material is as close to perfect as a material could be for the extremely narrow environment of use of mesh utilized on lacrosse sticks to create a pocket thereon. In this regard, the INNEGRA S mesh has a density of 0.84 as opposed to the density of typical polypropylene, 0.9, and is significantly less dense than other materials traditionally utilized to create a lacrosse pocket such as, for example, nylon (1.15), polyester (1.38), or cotton (1.54). Moreover, the INNEGRA S material is hydrophobic, exhibiting extremely low moisture absorption, if any. Before breaking, it will only stretch no more than 11% and it is an extremely strong material resisting stretching and breakage much more than nylon material. It has a useful temperature range of from −120° F. to +212° F. It does not require any coatings to stiffen it or soften it and maintains its feel and consistency throughout the range of temperatures within which it is utilized.

The striations and crevices 25 cause the material to facilitate enhanced ball retention without adding whip. The fact that it does not require any coatings or mixture with any resins means it breaks in immediately, never changes its hardness/feel over its lifetime, and requires about zero maintenance by its user.

Its significantly lower density as compared to other materials typically used in lacrosse stick mesh, namely, nylon, polyester or cotton, means that it can be used with a weave bearing diamonds the same size as those of mesh made of the other materials while significantly and dramatically reducing the weight of the mesh and therefore of the stick as a whole. As a result, given the relationship between force applied, mass, and velocity, the reduced mass results in dramatically enhanced head speed for equal force application. This enhancement can be further enhanced due to the most negligible stretchability of the material by making the diamonds larger in dimensions, thereby reducing the weight even further.

All of these factors combine together to create a lacrosse mesh which when installed on the head of a lacrosse stick can dramatically enhance performance while reducing maintenance, enhancing durability, and enhancing lacrosse head speed to allow the user with equal force application to shoot the ball harder toward the net and to pass more crisply.

As such, an invention has been disclosed in terms of a preferred embodiment thereof which fulfills each and every one of the objects of the present invention as set forth hereinabove, and provides a new and useful improved lacrosse mesh of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A mesh mounted on a head of a lacrosse stick, comprising:

a) plural fibers woven into rope and then woven into a mesh material having a plurality of openings defined by surrounding woven fibers, said fibers being fabricated from a processed polypropylene material having a lower density than raw polypropylene, namely, about 0.84 g/cm$^3$, said fibers being hydrophobic and having a rough, non-smooth surface texture formed by crevices in outer surfaces of said fibers, said fibers resisting stretching and breakage but being able to stretch no more than about 11% before breaking;

b) said mesh material mounted within an opening of said lacrosse stick head;

c) a plurality of string sections interwoven into said mesh material to facilitate formation of a pocket that substantially maintains its shape and configuration; and d) said mesh material being uncoated.

2. The mesh of claim 1, wherein said openings are diamond shaped.

3. The mesh of claim 1, wherein said rope has a diameter of 1.5 to 2.5 millimeters.

* * * * *